US006932046B2

(12) United States Patent
Hausler et al.

(10) Patent No.: US 6,932,046 B2
(45) Date of Patent: Aug. 23, 2005

(54) TWO CYCLE ENGINE HAVING MINIMAL LUBRICATION

(75) Inventors: Wolfgang Hausler, Munich (DE); Josef Sollinger, Mallersdof-Pfaffenberg (DE); Georg Sick, Feldafing (DE)

(73) Assignee: Wacker Construction Equipment AG, Munich (DE)

( * ) Notice: Subject to any disclaimer, the term of this patent is extended or adjusted under 35 U.S.C. 154(b) by 0 days.

(21) Appl. No.: 10/363,845

(22) PCT Filed: Sep. 13, 2001

(86) PCT No.: PCT/EP01/10602

§ 371 (c)(1),
(2), (4) Date: Mar. 6, 2003

(87) PCT Pub. No.: WO02/23016

PCT Pub. Date: Mar. 21, 2002

(65) Prior Publication Data

US 2004/0011308 A1 Jan. 22, 2004

(51) Int. Cl.[7] ..... F01M 1/00
(52) U.S. Cl. ..... 123/196 R; 123/73 AD
(58) Field of Search ..... 123/196 R, 73 AD

(56) References Cited

U.S. PATENT DOCUMENTS 1,603,173 A * 10/1926 Watts ..... 123/196 R
3,204,619 A * 9/1965 Rubinowitz et al. .... 123/196 R
5,339,779 A * 8/1994 Zettner ..... 123/197.4
5,375,573 A * 12/1994 Bowman ..... 123/196 R
5,581,891 A * 12/1996 Wheeler et al. ..... 30/216
5,588,504 A * 12/1996 Spiegel et al. ..... 123/195 R
5,806,631 A * 9/1998 Yoshida et al. ..... 123/196 R
5,826,556 A 10/1998 Runman et al.

FOREIGN PATENT DOCUMENTS

| | | | | |
|---|---|---|---|---|
| DE | 42 43 571 A1 | | 6/1994 | |
| EP | 0 609 866 A1 | | 2/1994 | |
| EP | 0 943 788 | | 2/1999 | |
| JP | 62020611 A | * | 1/1987 | ..... F01M/3/00 |
| WO | WO 00/28194 | | 5/2000 | |
| WO | WO 00/53900 | | 9/2000 | |

* cited by examiner

*Primary Examiner*—Noah P. Kamen
(74) *Attorney, Agent, or Firm*—Boyle Fredrickson Newholm Stein & Gratz S.C.

(57) ABSTRACT

The invention relates to a two cycle engine comprising a lean lubrication system, whereby the lubrication oil is only applied in the area of a contact surface between a piston and a cylinder. An oil outlet is provided in or below a running surface pertaining to the cylinder for this purpose. An oil aerosol can be applied alternately, according to the position of the piston, onto the running surface of a shaft pertaining to the piston and onto the running surface of the cylinder via said oil outlet.

5 Claims, 3 Drawing Sheets

TWO CYCLE ENGINE HAVING MINIMAL LUBRICATION

BACKGROUND OF THE INVENTION

1. Field of the Invention

The invention relates to a two cycle engine and to a tool using the two cycle engine.

2. Description of the Related Art

By reason of their high specific output, position-independent usability and their low weight two cycle engines of this type are preferably used in tools, in particular hand-held tools.

In essence, two principles are known for the lubrication of two cycle engines, namely petroil lubrication, in which oil is admixed beforehand to the fuel at a mixing ratio of 1:25 to 1:100, and separate-lubrication, in which oil is pumped from a separate oil tank by means of an oil pump into the crank housing or the carburettor nozzle. Both lubricating methods help make it possible to utilise two cycle engines in any position and also serve to keep the weight of such engines low.

Whereas with petroil lubrication the oil must be added to the fuel during each fuelling procedure, it is necessary in the separate-lubricating process to top up the separate oil tank at regular intervals, as in the case of two cycle engines there is basically a loss lubrication, i.e. there is no oil circulation. A certain portion of the oil thus does not contribute to the lubrication but is burnt without having been used. An excessively large amount of oil therefore has to be supplied to the engine, which not least increases the total weight of the two cycle engine by reason of the oil reserve.

A two cycle engine is known from U.S. Pat. No. 4,794,896 A in which oil can be discharged via an oil outlet into the region of a contact surface between a piston and a cylinder.

OBJECTS AND SUMMARY OF THE INVENTION

It is the object of the invention to provide a two cycle engine with reduced requirements for lubrication oil.

A two cycle engine in accordance with the present invention is characterized in that oil in the form of an oil aerosol can be discharged to a running surface of a piston skirt of the piston and onto a running surface of the cylinder.

It has been established that the tribological loading of the two cylinder engine is greatest in the region of the contact surface between the piston and the cylinder, i.e. the friction surface between the piston, or piston rings which may be provided, and the cylinder. It is thus of enormous advantage if wetting with oil takes place only in this region in order to avoid penetration of oil into the combustion chamber and subsequent combustion of the oil on the one hand and the presence of an oil sump in the crank chamber below the piston on the other hand. By controlled discharge of oil in the form of an oil aerosol into the contact surface between the piston and cylinder even extremely small quantities of oil will suffice to achieve sufficient lubrication.

In one particularly advantageous embodiment of the invention the oil can be discharged onto a running surface, i.e. an outer surface of a piston shaft of the piston and/or onto a running surface of the cylinder, wherein for this purpose a corresponding oil outlet should be suitably provided in or below the running surface of the cylinder. The discharge of the oil can then take place in the cycle of the engine in such a way that oil is first discharged onto the running surface of the piston shaft when the piston is located in the region of its lower dead centre, and later, when the piston reaches its upper dead centre, wetting of the running surface of the cylinder takes place.

The oil aerosol can be produced either by the oil outlet itself or can be supplied in the form of an oil aerosol to the oil outlet.

It is particularly advantageous if the oil outlet is formed as an inclined nozzle directed into the cylinder. The nozzle effect then reaches into the cylinder although the nozzle can be disposed below the running surface of the cylinder. In this way the nozzle is able to wet the inner surface (running surface) of the cylinder with oil.

An improvement in the economic use of the lubrication oil is possible in accordance with the invention if the discharge of oil from the oil outlet can be controlled in dependence upon the load state of the two cycle engine. Thus, for example no-load operation can take place without any supply of lubrication oil, while in full-load operation it may be necessary to provide a larger amount of oil in order to protect highly loaded components.

The two cycle engine in accordance with the invention is used to particular advantage in a tool, in particular a hand-guided tool in which the two cycle engine is coupled to a movement-conversion device disposed in a housing, and the two cycle engine can be lubricated with oil from the housing of the movement-conversion device. By appropriate arrangement of the components and of the lubrication system the two cycle engine can even be lubricated exclusively by the oil from the housing without additional lubrication oil being required, for example in a separate oil tank or by admixture into the fuel.

By means of the lean or minimal lubrication system the weight of the two cycle engine and therefore of the tool can be reduced considerably. Furthermore, measures which have previously been common such as the preparation of the oil-fuel mixture, the provision, cleaning and maintenance of a separate oil tank or the monitoring of the oil reserve by appropriate devices is no longer required. The structure of the two cycle engine can thereby be considerably simplified which also increases its reliability.

BRIEF DESCRIPTION OF THE DRAWINGS

This and further advantages and features of the invention will be explained in detail hereinunder with the aid of an example with reference to the accompanying Figures, in which.

DETAILED DESCRIPTION OF THE PREFERRED EMBODIMENTS

Figure 1:
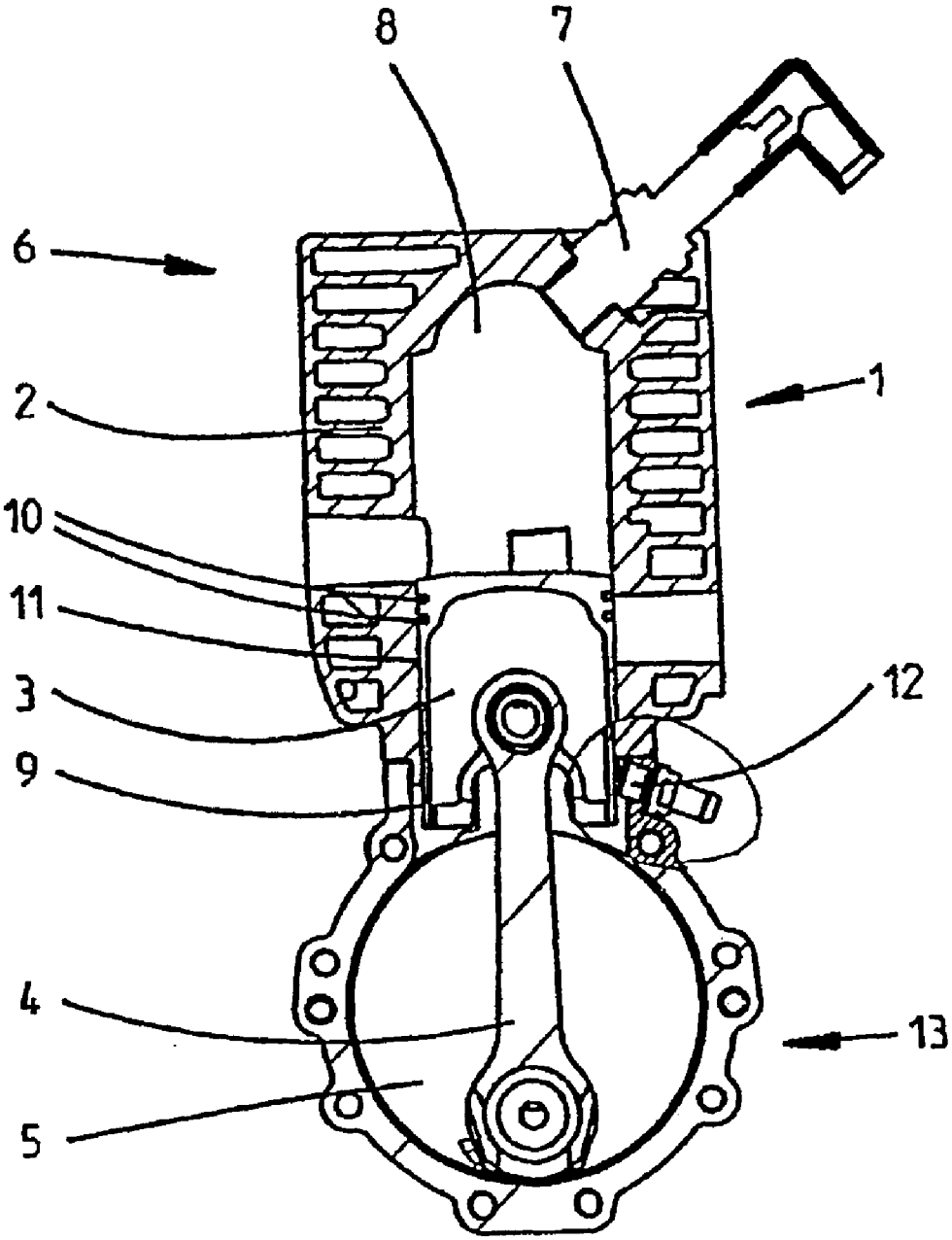
FIG. 1 shows a cross-sectional view through a two cycle engine in accordance with the invention, wherein a piston is in the lower dead centre.
Figure 2:
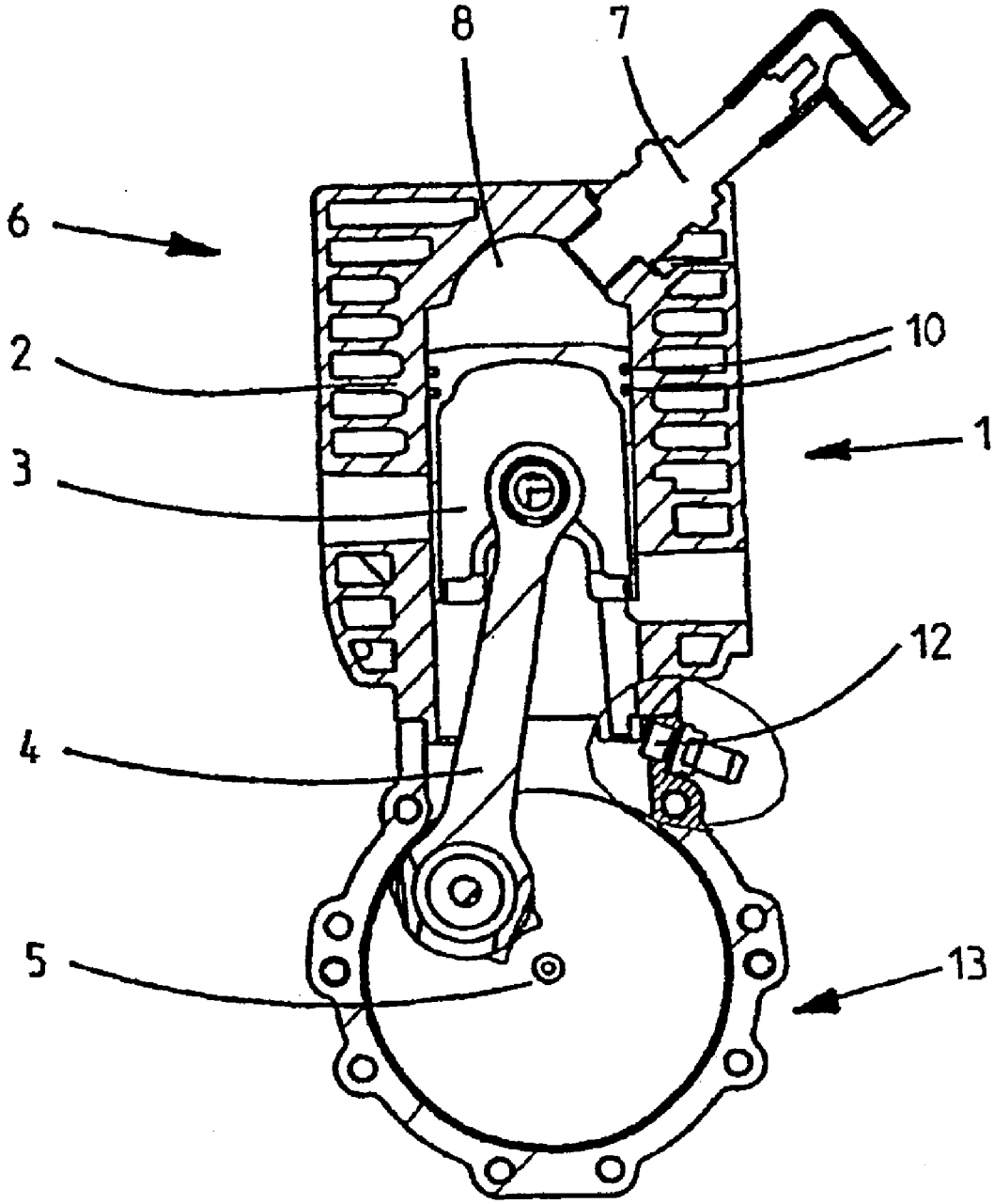
FIG. 2 shows a cross-sectional view in accordance with FIG. 1, wherein the piston is located just before the upper dead centre.

FIGS. 1 and 2 each show a two cycle engine 1 in accordance with the invention, having a cylinder 2 and a piston 3, which moves in the cylinder 2 and which in a known manner causes a crank or drive shaft 5 to rotate by means of a connecting rod 4.

A two cycle engine 1 known thus far is frequently used as a two cycle engine in hand-guided tools such as rammers for ground-compaction purposes.

In the upper part of a cylinder housing 6, which encloses the cylinder 2, a spark plug 7 is inserted which produces an ignition spark in a combustion chamber 8 at the correct time, whereby the air-fuel mixture, which is compressed by the upwards movement of the piston 3, is burnt and drives the piston 3 downwards in the direction of its bottom dead centre shown in FIG. 1 and thereby rotationally drives the drive shaft 5.

The operation of a two cycle engine is generally known and will therefore not be explained in greater depth.

This piston 3 consists substantially of one lower part, which is also designated as a piston sleeve or piston skirt 9, and an upper part which is designated as the piston head and in the periphery of which piston rings 10 are inserted.

The whole cylindrical outer surface of the piston 3 is designated as a running surface. Conversely, the part of the cylindrical inner surface of the cylinder 2 is designated as the running surface 11 of the cylinder 2, on which the piston 3 and the piston rings 10 slide.

Below, i.e. outside the running surface 11 of the cylinder 2 a nozzle 12, which serves as an oil outlet, is inserted in an inclined manner in such a way that its direction of injection reaches into the cylinder 2. By way of the nozzle 12 oil can therefore be introduced into the cylinder 2 and especially onto its running surface 11, as shown, for example in FIG. 2. Alternatively, the nozzle 12 can also be formed in the running surface 11 of the cylinder 2.

The wetting of the running surface 11 of the cylinder 2 demands that the piston 3 is located in the proximity of its upper dead centre position shown in FIG. 2. When the piston 3 reaches its lower dead centre position shown FIG. 1 it covers the running surface 11 of the cylinder 2 in such a way that it can no longer be wet with oil by the nozzle 12. Instead of this, however, a part of the piston skirt 9 is exposed so that oil from the nozzle 12 can then wet the piston skirt 9.

By means of this exchange cycle a uniform lubrication of the cylindrical surfaces 9, 11 of the cylinder 2 and piston 3 over the entire periphery is possible.

In accordance with FIGS. 1 and 2 therefore either the right-hand part of the piston skirt 9, and therefore indirectly the right-hand part of the running surface 11 of the cylinder 2, or—when the piston 3 is in the upper dead centre—the left-hand part of the running surface 11 of the cylinder 2, and therefore indirectly also the left-hand part of the piston skirt 9, is lubricated. Since the piston rings 10 also reach the lubricated regions of the running surface 11 of the cylinder 2 they are also supplied with oil.

The oil supply by means of the nozzle 12 can take place continuously or in a pulsed manner, wherein control depending on the position of the piston 3 or even under consideration of the operating state of the two cycle engine 1 is particularly advantageous.

Particularly effective lubrication is possible when the oil is supplied not in liquid form but as an oil aerosol or mist. The extremely fine droplets permit the oil to be widely distributed without the lubrication effect being reduced.

Therefore, in accordance with one embodiment of the invention provision is made for the oil to be supplied to the nozzle 12 in liquid form and there to be atomized under pressure. Alternatively it is possible for the oil to be supplied to the nozzle 12 or to a correspondingly formed outlet in the form of an oil aerosol and then it merely has to be directed onto the running surface 11 of the cylinder 2 or onto the piston skirt 9.

As an alternative to the nozzle 12 or to a corresponding non-pressurised outlet it is also possible to provide a plurality of outlets or nozzles, for example in the form of a nozzle ring, in order to permit penetration of oil into the running surface 11 of the cylinder 2 from below.

The quantity of the oil supplied should be such that reliable lubrication of the piston 3 in the cylinder 2 is possible. However, in order to minimise oil consumption oil should be prevented from exiting into the combustion chamber 8 or into a crank chamber 13 located below the piston 3. It may accordingly be necessary for further moveable parts of the two cycle engine 1, in particular connecting rod bearings, to be given separate lubrication, for example life-time lubrication, which is independent of the oil lubrication of the piston 3, or for them to be produced from suitable materials.

The oil supply should be adjusted in such a way that the piston rings 10 remain moveable and cannot become fixed in the annular grooves which receive them for lack of sufficient lubrication. In order to reduce the oil consumption still further it may be necessary to arrange the piston rings 10 as so-called wedge-type rings and to provide the piston skirt 9 with an emergency running coating, for example with Graphal®.

Figure 3:
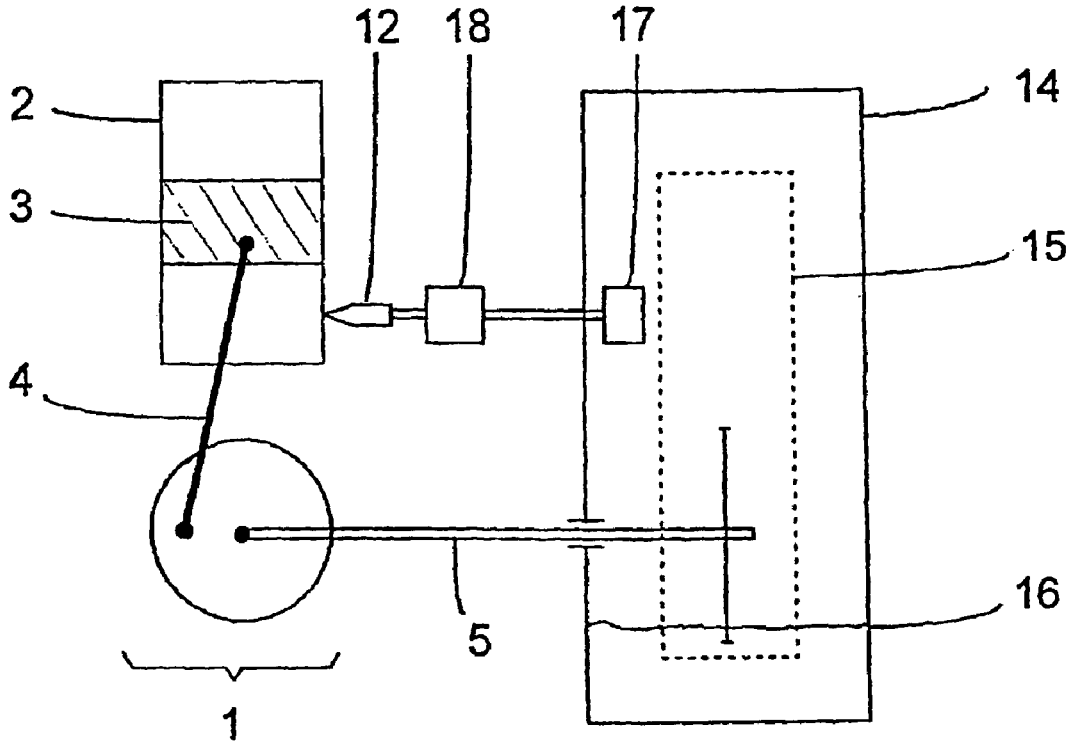
FIG. 3 schematically illustrates the structure of a tool using the two cycle engine in accordance with the invention.

The two cycle engine in accordance with the invention can be used to particular advantage in a tool, in particular a hand-guided tool, as shown schematically in FIG. 3.

The two cycle engine 1 is sketched in the left-hand part of FIG. 3. Its drive shaft 5 extends out of the housing of the two cycle engine 1 into a housing 14 which surrounds a movement-conversion device 15. The movement-conversion device 15 can comprise different types of toothed wheel transmissions, crank transmissions, etc. and serves substantially to convert the directions of movement, types of movement (translatory, rotary; continuous, intermittent, oscillatory, jerky, etc.) and movement speeds. The movement-conversion device 15 is sketched in FIG. 3 merely in a schematic manner in the form of a toothed wheel and a frame, as illustrated by dotted lines, which surrounds said toothed wheel.

The moving components of the movement-conversion device 15 are lubricated with oil which is introduced into the housing 14 which is indicated symbolically in FIG. 3 by an oil sump 16.

By reason of the high speeds of the moving components of the movement-conversion device 15, oil is extensively centrifuged out of the oil sump 16 in a continuous manner and swirled in the form of large and small droplets. After merely a short period of time, an oil mist consisting of an oil aerosol and made up of extremely fine droplets of oil is formed in the housing 14 and this wets all of the parts which are to be lubricated.

A part of the oil aerosol is collected by a collecting device 17 which constitutes substantially an orifice in the housing 14, into which the oil aerosol can issue. At this site, it can be expedient to provide filters or porous, sponge-like materials, in order to filter the oil aerosol.

A conveying device 18 serves to guide the oil aerosol from the collecting device 17 to the nozzle 12 serving as an oil outlet. The conveying device 18 can be formed in various ways and can transport the oil in liquid form or as an oil aerosol in a pressurised or non-pressurised manner depending on the arrangement of the lubrication system.

With appropriate arrangement it is possible in this tool for the two cycle engine 1 to be lubricated exclusively by the oil from the housing 14. An additional oil supply as in the prior art is therefore no longer necessary. It is neither necessary to introduce an oil-fuel mixture nor to provide a separate oil reservoir.

We claim:

1. Use of a two cycle engine having at least one cylinder and a piston which can move in the cylinder, wherein oil is discharged exclusively in the form of an oil aerosol, in the region of a contact surface between the piston and the cylinder, onto a running surface of a piston skirt of the piston and onto a running surface of the cylinder;

in or below the running surface of the cylinder, there is provided an oil outlet which is coupled to a conveying device and through which the oil aerosol is discharged onto the running surface of the piston skirt and onto the running surface of the cylinder, wherein the oil aerosol is discharged from the oil outlet alternately 1) onto the running surface of the piston skirt when the piston is located in the proximity of a lower dead center thereof, and 2) onto the running surface of the cylinder when the piston is in the proximity of an upper dead center thereof; wherein the quantity of the oil supplied is such that oil is minimized from exiting into a combustion chamber or into a crank chamber located below the piston; wherein the piston is coupled to a crank shaft via a connecting rod and a connecting rod bearing; wherein the connecting rod bearing has life-time lubrication or has a material pairing requiring no additional lubrication, wherein the tool has a movement-conversion device disposed in a housing for conversion of a rotary movement produced by the two cycle engine into a working movement; and wherein the two cycle engine is disposed on or in the housing;

the housing is supplied with oil for the purpose of lubricating the movement-conversion device; and the two cycle engine is lubricated by the provision of the oil from the housing to the oil outlet.

2. The use as claimed in claim 1, wherein the two cycle engine is lubricated exclusively by the oil from the housing.

3. The use as claimed in claim 1, wherein the conveying device serves to convey oil from the housing to the two cycle engine.

4. The use as claimed in claim 1, wherein the oil is an oil aerosol which is produced in the housing by the movement-conversion device.

5. A tool comprising:

an engine operable using oil lubrication for at least one cylinder and a piston so as to produce a rotary movement, the piston operable to move in the cylinder, the at least one cylinder having a running surface, the piston including a piston skirt having a running surface, the piston movable between a proximity of a lower dead center position and a proximity of an upper dead center position;

oil supply means for supplying a lubricant oil aerosol;

an oil outlet, located in a region of a contact surface between the piston and the at least one cylinder, that discharges an oil aerosol onto the running surface of the piston skirt and onto the running surface of the at least one cylinder;

conveying means, for conveying oil from the oil supply means to the oil outlet such that the oil aerosol is discharged onto the running surface of the piston skirt and the running surface of the at least one cylinder, movement-conversion means, disposed in a housing, for conversion of a rotary movement produced by the two cycle engine into a working movement, wherein the oil aerosol is discharged from the oil outlet alternately onto the running surface of the piston skirt when the piston is located in the proximity of the lower dead center position, or is discharged onto the running surface of the at least one cylinder when the piston is in the proximity of the upper dead center position, wherein the quantity of the oil aerosol supplied is such that the oil aerosol is minimized from exiting into a combustion chamber or into a crank chamber located below the piston, wherein the two cycle engine is disposed on or in a housing, wherein the housing is supplied with oil for the purpose of lubricating the movement-conversion means, and wherein the two cycle engine is lubricated by the provision of the oil from the housing to the oil outlet.

* * * * *